United States Patent [19]

Hanson

[11] 4,023,210

[45] May 17, 1977

[54] UNIVERSAL FLIP-UP ATTACHMENT FOR HELMETS

[76] Inventor: Gary L. Hanson, P.O. Box 3302, Bellevue, Wash. 98009

[22] Filed: May 21, 1975

[21] Appl. No.: 579,483

[52] U.S. Cl. ..... 2/10

[51] Int. Cl.[2] ..... A41D 13/00

[58] Field of Search ..... 2/10, 8, 9, 6

[56] References Cited

UNITED STATES PATENTS

| | | | |
|---|---|---|---|
| 2,610,323 | 9/1952 | Johnson | 2/8 |
| 2,725,560 | 12/1955 | Feldman | 2/10 |
| 3,009,158 | 11/1961 | Comeau et al. | 2/6 X |
| 3,721,994 | 3/1973 | De Simone et al. | 2/10 X |
| 3,797,042 | 3/1974 | Gager, Jr. | 2/10 |
| 3,805,294 | 4/1974 | Rose et al. | 2/10 |

*Primary Examiner*—Werner H. Schroeder
*Assistant Examiner*—Peter Nerbun

[57] ABSTRACT

A flip-up attachment for securing a windshield or other protective device to a helmet including a first element which is removably secured to the helmet in a sealed relationship therewith and a second element which is pivotally attached to the first element and includes as an integral part thereof means whereby commercially available face shields may be removably secured thereto without modification of either the attachment or the face shield. The two elements of the flip-up attachment are so arranged and configured that when the windshield is in the down or face protecting position a seal is formed between the two elements. The attachment between the two elements of the flip-up device includes a means whereby the relative friction may be adjusted, thus assuring that the windshield will be retained in its upward or in a semi-upward position when so desired. The two elements are latched together when in the downward position thus preventing the inadvertent relative movement during usage.

8 Claims, 9 Drawing Figures

FIG. 1
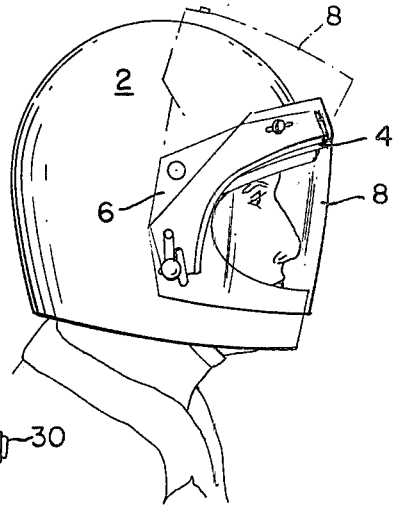
FIG. 2
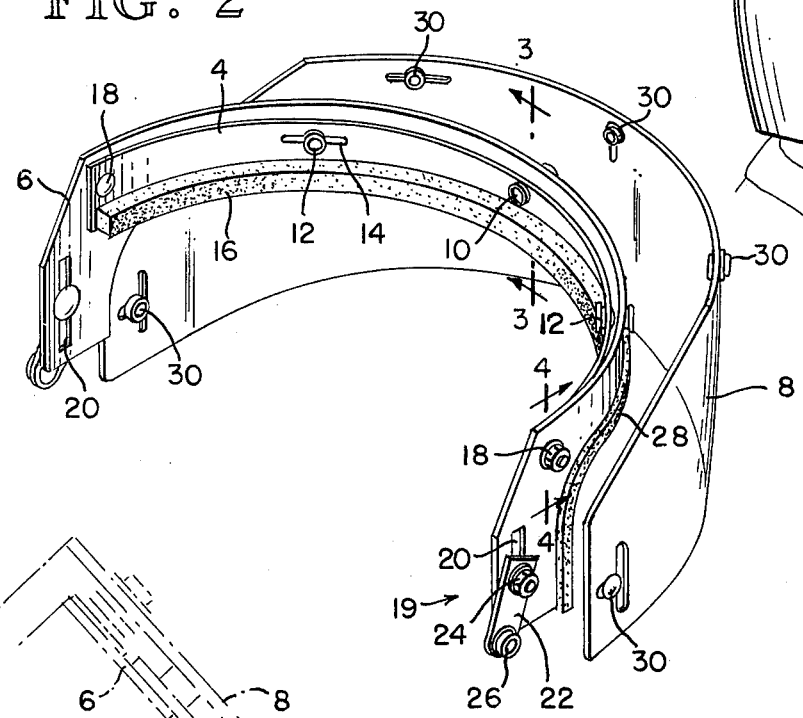
FIG. 4
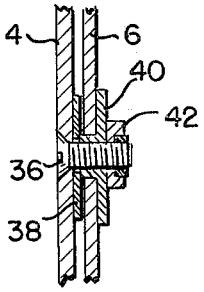
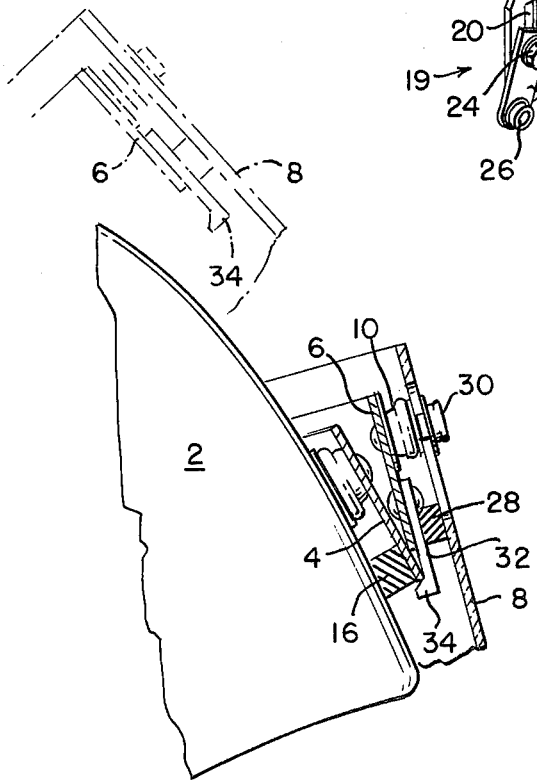
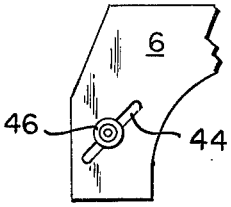
FIG. 6
FIG. 3
FIG. 5
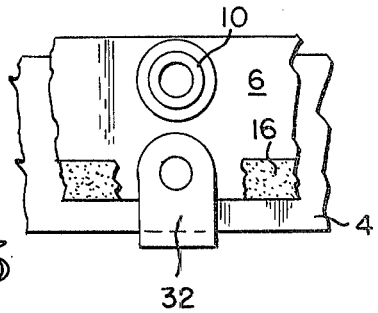

FIG. 7
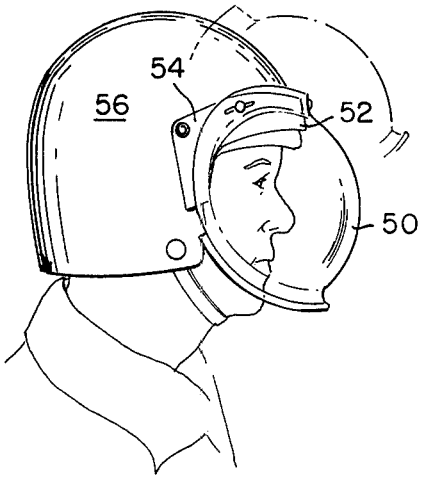
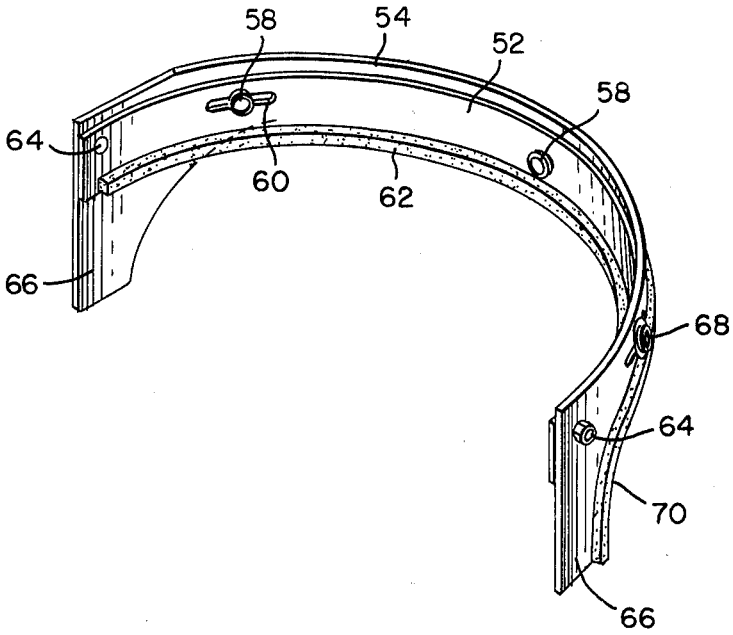
FIG. 8
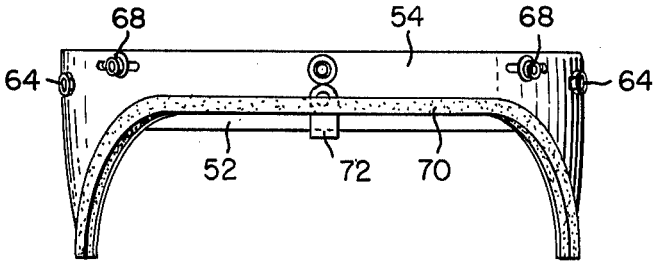
FIG. 9

UNIVERSAL FLIP-UP ATTACHMENT FOR HELMETS

BACKGROUND OF THE INVENTION

Protective helmets and/or headgear have long been utilized in such dangerous fields as construction and welding. It has recently become the law in most states that riders of motorcycles and/or trail bikes must wear the protective headgear in order to operate the vehicle on the highway systems. One of the areas of the head which requires protection and yet which necessitates the capability of being exposed when necessary for conversation or the like is the face. Most of the helmets which are on the market today cover the majority of the head to a position just above or at the eyebrows and then curve down to a position slightly forward of the ears. Some of the helmets, however, known as full helmets, extend forwardly at the bottom edge thereof to provide protection for the chin and jaw areas. When a face shield, wind screen or the like is used with these helmets, it is necessary to be able to remove this element for conversation or the like.

The historical development of the protective visor can be seen in the prior art known to the present inventor and includes U.S. Pat. No. 2,302,231 granted to Lobelle on Nov. 12, 1942. This particular reference deals with a means for protecting the eyes of the wearer of a military-type steel helmet and includes a visor which is pivotally attached such that it can be pushed upwardly up into the interior of the helmet when not in use.

U.S. Pat. No. 2,631,386, granted to Bowers on Mar. 17, 1953, likewise deals with a protective shield which is utilized in conjunction with a skull guard such as is worn by industrial workers. This particular helmet attachment includes a strap means permanently secured to the face shield which is then removably attached to the helmet. The face shield is either in a down position protecting the face or in an up position where at it is pivoted completely to the rear of the helmet per se.

U.S. Pat. No. 2,635,239, granted to Bivens on Apr. 21, 1953, discloses an elaborate head strap means utilized for securing a pair of lenses before the wearer's eyes.

U.S. Pat. No. 3,137,005, granted June 16, 1964 to Herbine et al., discloses yet another method of removably attaching a face protector to a construction type helmet which includes a spring biased band which is wrapped around the exterior of the helmet and held in place by a snap means and includes as an integral part thereof a means to pivot the helmet upwardly, out of the line of vision.

U.S. Pat. No. 3,594,816, granted to Webb et al., on July 27, 1971, includes yet another means of securing a face shield to a construction type helmet and includes a two piece strap which may be adjustable secured to the helmet and as an integral part includes pivot means whereby the face shield may be moved into or out of the line of vision of the wearer.

A retractable face protective assembly more directly applicable to the present invention is disclosed in U.S. Pat. No. 3,727,335, granted to Fisher on Apr. 17, 1973. This particular face shield comes as an integral unit which is secured to the helmet and includes an arcuate track as a part of the face shield. The portion of the face shield which attaches to the helmet has an outwardly projecting element which fits into the track and limits the movement of the face shield from a position out of the line of vision downwardly to a position in front of the face.

U.S. Pat. No. 3,797,042, granted to Gager, Jr. on Mar. 19, 1974 includes a bill-like apparatus which is secured to the front of the helmet and is adapted to pivotally receive thereon a wind or face shield which is movable from the down, locked position, protecting the face, to an upwardly retracted position allowing access to the face.

U.S. Design Pat. No. 168,057, granted to Margwarth on Oct. 28, 1952 deals primarily with a pilot's helmet and includes a movable visor assembly which is pivotally secured to the cap and operates along a track assembly mounted to the top of the helmet itself.

U.S. Design Pat. No. 228,700, granted to Gager, Jr. on Oct. 23, 1973, directs itself to a design aspect of the above noted structural application.

With the above noted prior art in mind it is readily apparent that there is no currently available means whereby a face shield may be readily attached and/or removed from a helmet such as a motorcycle helmet and still give the operator the ability to pivot the windshield upwardly for conversation or the like. Thos pivotal brackets presently known to the inventor are either limited to a specific configuration of the face shield or are formed as a part of the face shield, thus preventing the replacement of only the shield portion of the assembly. Yet another detrimental aspect of the face shield mounting brackets currently on the market lies in the fact that they do not fit snugly against the helmet or in fact the elements themselves do not fit tightly against each other, thereby allowing a distracting and dangerous downdraft of wind through the helmet when the vehicle is traveling at highway speeds.

With the above noted problems and prior art in mind it is an object of the present invention to provide a bracket attachment for use in conjunction with motorcycle helmets whereby the operator may readily, easily and inexpensively replace the windshield upon his helmet and further, an attachment giving the operator the ability to easily remove the windshield from in front of his face at desirable times.

It is yet another object of the present invention to provide a removable bracket means for use with motorcycle helmets to support a face shield wherein the bracket elements when the face shield is in a down or face covering position form a weather-tight seal preventing the inflow of water and/or wind. Further the interconnection between the windshield itself and the bracket is for the same reasons likewise sealed.

Still another object of the present invention is to provide a removable bracket for use upon a motorcycle helmet or the like wherein the bracket comprises two pivotally secured elements, the first one to be attached to the helmet itself and including means whereby the element will accommodate different snap positions upon the helmet and the second element including means at the opposite ends of its arcuate portion permitting adjustment of the length and/or shape to accommodate windshields of a great variety of configurations and snap positions.

Still another object of the present invention is to provide a two piece pivotally secured attachment for motorcycle helmets or the like wherein the pivotal portion can be adjusted as to the amount of friction thereby permitting the bracket to accommodate both light and heavy face shields without structural modification.

BRIEF DESCRIPTION OF DRAWINGS

FIG. 1 is an environmental view of the present invention as mounted upon a full helmet.

FIG. 2 is an isometric view of the present invention showing the relative positions of the two removable brackets as well as one type of face shield exploded away from the bracket for clarity.

FIG. 3 is a view taken along lines 3—3 of FIG. 2 showing the relative relationship of the two bracket elements when the face shield is down as well as more clearly illustrating the means for locking the face shield in its down position.

FIG. 4 is a view taken along line 4—4 of FIG. 2 illustrating the means whereby the amount of friction between the two elements of the bracket can be adjusted.

FIG. 5 is an enlarged view showing the relationship of the latch mechanism and the two brackets when in closed position.

FIG. 6 is a partial view of an alternative means of adjusting the snap position in the outermost end of the pivotable bracket portion.

FIG. 7 is an environmental view showing a modified bracket for use upon particular helmets.

FIG. 8 is an isometric view of the attachment as shown in FIG. 6.

FIG. 9 is an elevational view of the bracket as shown in FIG. 6.

DETAILED DESCRIPTION OF DRAWINGS

As seen in FIG. 1 the present inventive helmet attachment is particularly designed for utilization in conjunction with a motorcycle helmet, however, it is not intended that the protection be limited to this application. As seen in this figure, a full helmet 2 is placed in position upon a person's head and has mounted thereon a removable bracket having a relatively fixed portion 4 and a portion 6 pivotally mounted thereto. A face shield or windshield 8 is secured to the pivotal portion and thereby movable from the position as shown in solid to the position as shown in phantom lines, thus removing it from in front of the face of the wearer.

Referring now to FIG. 2, the first or relatively fixed portion of the removable bracket consists of arcuate element 4 which includes as an integral part thereof female snap fasteners 10 and 12. It is to be noted that the snap fastener 10 is secured at the center of the arcuate element whereas the snap fasteners 12 are slidably movable along the arc of the element 4 in grooves 14 provided therein. The first or relatively fixed bracket element 4 also includes as an integral portion thereof an arcuate strip of protection 16 which extends from one end of the arcuate portion to the other and sealingly engages the front of the helmet preventing the downward flow of water and/or air. Adjustable pivot means 18, to be described in greater detail hereinafter, are secured at the outermost ends of the arcuate portion 4 and provide the adjustable means for securing the second element 6 of the removable bracket to the first element and yet permit relative motion therebetween. It is to be noted that whereas the major portion of the arcuate, relatively moveable element 6 conforms generally with the arcuate portion 4, it at its opposing outer ends extends downwardly and rearwardly from the ends of 4 to terminate in an adjustable mechanism 19 permitting the bracket to be utilized for a multiplicity of various windshields. The adjusting mechanism 19 includes a substantially vertical slot 20, when the bracket is in position, in the ends of the bracket and an elongated lever means 22 having one end pivotably secured by a lock nut assembly 24 within the slot 20 thus permitting relative movement and positioning therebetween. The opposite end of elongated element 22 from that pivotally secured to the bracket has mounted thereon a snap fastener 26 for securement to the windshield. It becomes readily apparent that the utilization of the elongated element 22 at its positioning availability caused by the movement of the end of the element by sliding 24 within the slot 20 and the ability to pivot the entire lever around the lock nut 24 lends a great deal of versatility. It is also to be noted that the outer surface of the second element 6 includes weather stripping 28 to assure a tight securement to the windshield. Shown for illustration purposes only, a windshield 8, includes a plurality of snap fasteners 30 mounted in relative slots to permit slight adjustments to accommodate the fastening means.

As noted above, there are two critical aspects in the securement of the face shield of a helmet to the helmet itself, first is being able to pivot it upwardly so that it is not impeding the wearer and secondly, to be able to assure that it is locked down in position and there is no way whereby the air generated by movement of the wearer or the water caused by rain or snow will drip down onto the operator's face. As seen in FIG. 3 the windshield itself 8 and its snap fastener 30 are shown, the windshield abuts the weather stripping 28 and the snap fastener 30 engages the snap fastener 10 upon the second element of the two bracket elements.

Also seen in this view is the elongated locking mechanism 32 having an outwardly projecting lip portion 34 which is secured beneath the lower edge of the first secured bracket 4 when the shield is in the down position. It is to be noted that the lip 34 is at a slight angle to assist in release of the latch mechanism yet provides adequate securement. The relatively fixed bracket is secured to the helmet 2 by means of snap fastener 10 which mates with an opposite member mounted to the helmet 2. Note that the insulation or weather stripping 16 provides a seal between the first bracket and the helmet and the relative positioning and differences in arcs of curvature between the first element 4 and second element 6 provides a seal at the bottom edge of 6 where it abuts the outer surface of 4.

The angle which exists between the first element 4 and the second element 6, as noted above, is caused by the differing arcs of curvature. If the two elements are fabricated of flat stock, the necessary differences are generated by cutting the first element 4 with an arc in the flat stock while leaving the second element 6 essentially straight. When the two elements 4 and 6 are then bent to conform to the exterior surface of the helmet, the two elements, when secured together are at an angle to each other. The weather stripping 28 provides the seal between the second element 6 and the face shield itself.

Looking now at FIG. 4 which depicts the adjustable means whereby the relative friction between the first element 4 and the movable element 6 can be adjusted. The adjustment element comprises a press stud 36 which has no outwardly projecting portion to mar the helmet and extends through appropriately provided bores in elements 4 and 6. Mounted adjacent element 4 and surrounding the shaft of the press stud 36 is a fiber washer 38 which provides the contact between element 4 and 6. Outboard of the element 6 is a shoulder washer 40 which extends into the bore in element 6 and prevents the movement of element 6 from affecting the relative position of the lock nut 42. Thus, as can be seen, the wearer can adjust the amount of friction between the relatively movable elements by lock nut 42 and can thus be assured that repeated movement of the brackets from its upper to its lower position will not tend to loosen the lock nut 42.

Referring now to FIG. 5, a broken away view of the front of the invention attachment means is shown. The relative positions of the snap fastener, the latching mechanism 32, the insulation 16 and the two relatively movable brackets 4 and 6 are easily seen.

As in alternative to the pivotable arm 22 shown and described with respect to FIG. 2, a modification of this adjustment is shown in FIG. 6. The lower edge of one of the ends of the arcuate memeber 6 is shown and rather than the vertical slot 20 and pivotable arm as described hereinabove, there is shown a slot 44 placed at an angle and included therein is a snap fastener 46 which is movable the length of the groove 44 thus providing relative adjustment for accommodating various face shields.

Referring now to FIGS. 7, 8, and 9 taken in conjunction a more simplified version of the present invention is shown said version being utilized upon a specific helmet and with a specific shield. As seen in the general view FIG. 7 the helmet 56 has mounted thereon a first bracket 52 which has pivotally mounted thereto a second bracket 54 upon which is mounted a bubble type shield 50. These particular elements can be seen more readily in FIGS. 8 and 9 wherein the first bracket 52 is shown as including snap fasteners 58 similar to that described with respect to the embodiment hereinbefore.

Thus as can be seen the present invention provides a removable bracket attachment for utilization with a motor cycle helmet or the like wherein the bracket assembly may be simply and easily attached and/or removed and readily adjusts to various sizes and shapes and models of helmets as well as varying sizes and configurations of face shields. Perhaps more importantly than the universality of the present invention is the fact that it provides a tight seal thus preventing irritating and often dangerous inflow of wind and/or water to the face of the wearer. The unique construction of the outer ends of the arcuate portions of the brackets permits a great degree of adjustability and thus making the brackets essentially universal and adaptable to face shields manufactured in various styles and by different manufacturers.

What is claimed is:

1. An attachment for use with a safety helmet having a face opening permitting the rapid and easy raising and lowering of a removable face shield secured thereto comprising:

a. first bracket means for attachment to the helmet, said bracket means shaped to conform with the exterior of the helmet at a location generally above and adjacent the face opening, b. second bracket means for removably receiving the face shield said second bracket means pivotally secured to the first bracket means at a position adjacent the outer perimeter of the face opening, said second bracket means pivotably movable from a first position overlying the first bracket means, being substantially sealed and stopped thereagainst to a second position overlying the top of the helmet whereby a face shield attached to said second bracket means is capable of being moved from a protective position to a raised position.

2. An attachment as in claim 1 wherein the second bracket means is latched to the first bracket means when in the first position.

3. An attachment as in claim 1 wherein the face shield is removable and the second bracket means is substantially arcuate in configuration and includes infinitely adjustable extension means at its extremities to accommodate face shields of varying dimensions and configurations.

4. An attachment as in claim 3 wherein the extension mounted to the second bracket means are pivotable.

5. A universal face shield mounting means for use with protective headgear comprising:

a. a first arcuate element including sealing means upon its concave side for securement to the upper front portion of a helmet adjacent the face opening, b. a second arcuate element, for supporting a removable face shield, said second element being pivotably secured to the ends of the first element, extending downwardly therefrom and having separable mounting means thereon for securement of a face shield, the second element being shaped such that when the two elements are in overlying condition, the second element will abut and seal against the first element, and c. fastener means for releasably locking the second element in a position overlying the first element, that position whereat the face shield is down.

6. A universal face shield mounting means as in claim 5 wherein the second element includes pivotably mounted extensions at its extremities which include means for mounting the face shield.

7. A universal face shield mounting means as in claim 5 wherein the first and second elements have differing radii of curvature whereby they abut and form a seal when closed.

8. An attachment for use with protective head gear enabling the wearer to quickly and easily replace commercially available face shields or remove from the line of sight the face protective portion thereof, said attachment comprising:

a. first attachment means including movable fasteners for securing the first attachment means to a helmet and further including means forming a seal between the helmet and the first attachment means, b. second attachment means pivotally secured to the first attachment means, including means permitting securement of a face shield thereto and means of sealing by engaging the first attachment means when the two attachment means are in an overlying condition, and c. means to latch and secure the second attachment means to the first attachment means when the two attachment means are in an overlying condition.

* * * * *